US006552312B2

(12) United States Patent
Hammen et al.

(10) Patent No.: US 6,552,312 B2
(45) Date of Patent: Apr. 22, 2003

(54) ADJUSTABLE CAP SEALER HEAD

(75) Inventors: Richard R. Hammen, Menomonee Falls, WI (US); Ronald F. May, Lannon, WI (US)

(73) Assignee: Enercon Industries Corporation, Menomonee Falls, WI (US)

( * ) Notice: Subject to any disclaimer, the term of this patent is extended or adjusted under 35 U.S.C. 154(b) by 183 days.

(21) Appl. No.: 09/794,961

(22) Filed: Feb. 28, 2001

(65) Prior Publication Data

US 2001/0048203 A1 Dec. 6, 2001

Related U.S. Application Data

(60) Provisional application No. 60/186,181, filed on Mar. 1, 2000.

(51) Int. Cl.[7] ..... H05B 6/14
(52) U.S. Cl. ..... 219/633; 156/69
(58) Field of Search ..... 219/633, 632, 219/660, 661, 677; 156/69, 272.4, 274.2, 380.2; 439/271, 374, 378, 380; 53/488, 329.2; 198/444

(56) References Cited

U.S. PATENT DOCUMENTS 3,706,176 A * 12/1972 Leatherman ..... 53/488
4,095,390 A 6/1978 Knudsen
4,355,222 A * 10/1982 Geithman et al. ..... 219/633
4,936,943 A 6/1990 Kubis et al.
5,418,811 A 5/1995 Ruffini et al.
5,588,019 A 12/1996 Ruffini et al.
6,092,643 A * 7/2000 Herzog ..... 198/444
6,153,864 A 11/2000 Hammen et al.

FOREIGN PATENT DOCUMENTS

EP 0 842 854 A2 5/1998

* cited by examiner

*Primary Examiner*—Teresa Walberg
*Assistant Examiner*—Quang T Van
(74) *Attorney, Agent, or Firm*—Quarles & Brady LLP

(57) ABSTRACT

A sealing head for an inductive cap sealing apparatus includes a outer housing containing a coil bobbin supporting a wire coil wound about a magnetic isolator. The coil bobbin and the magnetic isolator can be axially repositioned independently to vary the magnetic field with respect to a container being sealed placed below the sealing head. The housing has a pair of axial apertures containing spring and push rod assemblies connected to a cap plate. The cap plate is spring loaded away from the outer housing so as to clamp the cap and/or seal against the container being sealed.

18 Claims, 4 Drawing Sheets

ADJUSTABLE CAP SEALER HEAD

CROSS-REFERENCE TO RELATED APPLICATIONS

This application claims benefit to U.S. provisional application serial No. 60/186,181 filed Mar. 1, 2000.

STATEMENT REGARDING FEDERALLY SPONSORED RESEARCH/DEVELOPMENT

Not applicable.

BACKGROUND OF THE INVENTION

The invention relates to the field of heat sealing caps to containers. In particular, the invention is an adjustable sealing head for an inductive cap sealing apparatus.

Inductive sealing is a well-known method for hermetically sealing the openings of containers. Inductive sealing requires an electromagnetic-field-producing apparatus and a foil-polymer seal. Typically, the apparatus includes at least one coil of wire wound to produce an electromagnetic field when electric current is supplied to the coil. It is well-known in the art that electromagnetic fields induce eddy currents within metal, which in turn heat the metal. The seal comprises a thin layer of aluminum foil onto which is laminated a polymer layer that is molecularly compatible with the container to be sealed. When the seal is placed onto the container and the container is placed within an electromagnetic field, the eddy currents in the foil give off energy in the form of heat, which melts the polymer layer. Removing the seal from the electromagnetic field allows the polymer to cool and molecularly fuse with the container to create an airtight seal. U.S. Pat. No. 6,153,864, assigned to the assignee of the present invention and hereby incorporated by reference, discloses an example of an inductive sealing apparatus using this technique.

Typically, containers to be sealed ride along on conveyers beneath one or more sealing heads. The sealing heads can be fixed in place or indexed in a rotary carriage. Multi-headed cap sealers typically provide higher sealing rates than single-headed cap sealers. In both cases, however, it is important for the sealing head to provide an appropriate magnitude of magnetic flux in the area of the container top. Too much flux can melt the container or weld the foil seal to the container such that it is difficult to remove. Too little flux will not adequately seal the container.

Typical inductive sealing apparatuses have an adjustable mounting frame to properly position the sealing head with respect to containers being sealed. Such an adjustment is usually adequate for cap seals with a single sealing head. However, slight differences in the coil winding and loop isolation of multiple sealing heads can cause variances in the magnetic flux at the container top. Thus, adjusting the head mounting frame does not correct for magnetic flux variations between the heads of a multi-headed cap sealer, which can result in inconsistent sealing of the containers.

Accordingly, there is a need in the art for an adjustable sealing head that can be used in a multi-headed cap sealer to compensate for magnetic flux variations between multiple sealing heads.

SUMMARY OF THE INVENTION

The present invention provides an adjustable sealing head for use with an inductive sealing apparatus. The sealing head includes a housing defining a cavity that is disposed about and extends along a central axis. A coil bobbin disposed in the housing cavity has a cylindrical support extending along the central axis about which a wire coil capable of producing a magnetic field when energized is wound. An adjustment mechanism attaches the coil bobbin to the housing and enables manual adjustment of the coil bobbin in the axial direction with respect to the housing.

In one preferred form, the coil bobbin is adjustably fastened to a cap plate fixed at one of the housing. Rotating the fasteners allows the coil bobbin to be axially repositioned with respect to the housing.

In one preferred form, the inner housing is adjustably mounted at its top to a radial member fixed to the housing in the central cavity. Rotating fasteners threaded into the radial member moves the coil bobbin axially with respect to the housing. Preferably, the cylindrical wall of the housing includes a pair of axial apertures housing a pair of spring and push rod assemblies mounting a lower cap plate. The spring and rod assemblies bias the cap plate away from housing so that the cap plate can clamp the cap and/or seal against a container being sealed placed beneath the sealing head.

In yet another preferred form, the sealing head is includes a magnetic isolator disposed within the cylindrical support about which the wire coil is wound. The magnetic isolator is contained in an isolator housing have an externally threaded end that engages a threaded bore in a radial member fixed to the housing or part of the movable coil bobbin. Rotating the isolator housing changes its axial position with respect to the coil bobbin so as to alter the magnetic flux lines produced by the wire coil when energized The invention thus provides a sealing head for an inductive cap sealer that can be adjusted with respect to its mounting frame. The magnetic flux at the opening of the container being sealed can be adjusted by changing the position of the coil with respect to the container. The magnetic flux can also be adjusted by changing the position of the coil with respect to a loop isolation element. The sealing head is particularly suitable for use with multi-headed cap sealers because each sealing head can be independently adjusted to provide consistent magnetic flux of the all the sealing heads despite slight variation in mounting location and sealing characteristics of each sealing head. Proper sealing is further ensured by the spring loading the cap plate to clamp the cap and/or the inner seal against the container being sealed.

The foregoing and other objects and advantages of the present invention will appear from the following description. In the description, reference is made to the accompanying drawings which form a part hereof and in which there is shown by way of illustration a preferred embodiment of the invention. Such an embodiment does not necessarily represent the full scope of the invention, however, a reference must be made therefore to the claims for interpreting the scope of the invention.

DETAILED DESCRIPTION OF THE PREFERRED EMBODIMENTS

Figure 1:
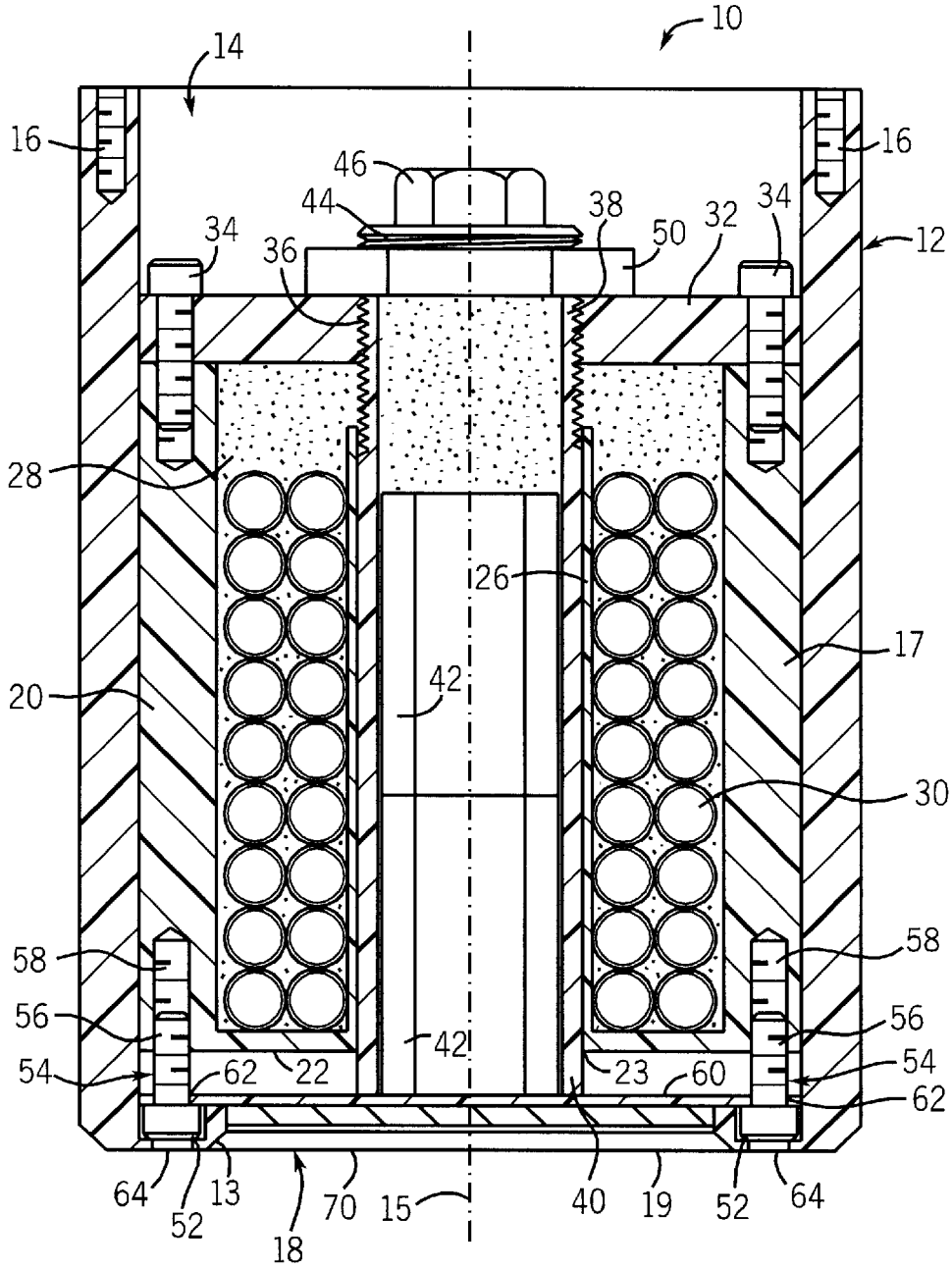
FIG. 1 is a side cross-sectional view of an adjustable sealing head according to the present invention, showing a moveable sealing head housing in a retracted position.

The sealing head of the present invention is illustrated in the drawings and referred to generally by reference 10. Referring to FIG. 1, the sealing head 10 is preferably used with a multi-headed inductive cap sealer (not shown) having an in-line or rotary lift mechanism (not shown) suitable for holding two or more such sealing heads. It should be noted, however, that the sealing head of the present invention may also be used with a single-headed cap sealer.

The sealing head 10 includes a housing 12 fixed to the lift mechanism by fasteners (not shown) disposed in bores 16 at the top of the housing 12. The housing 12 is generally cylindrical in shape defining a cylindrical cavity 14 along a central axis 15. A cap plate 18 at the bottom of the housing has a circular recess 19 concentric with the axis 15. The recess 19 has an inwardly tapered circumference 13, which helps center a container to be sealed with the sealing head 10.

A coil bobbin 20 is disposed in the cavity 14 of the housing 12 and has a cylindrical wall 17 with an open top and a radially extending bottom 22 defining an opening 23 concentric with the axis 15. A cylindrical wire support 26 extends along the axis 15 within the coil bobbin 20 from the opening 23. The coil bobbin 20 thus defines an annular chamber 28 in which a wire coil 30 is disposed. The coil 30 is comprised of suitable wire, such as litz wire, wrapped in a loop around the wire support 26. The ends of the coil 30 are preferably connected to a single power supply through suitable openings at the top of the housing 12.

Figure 2:
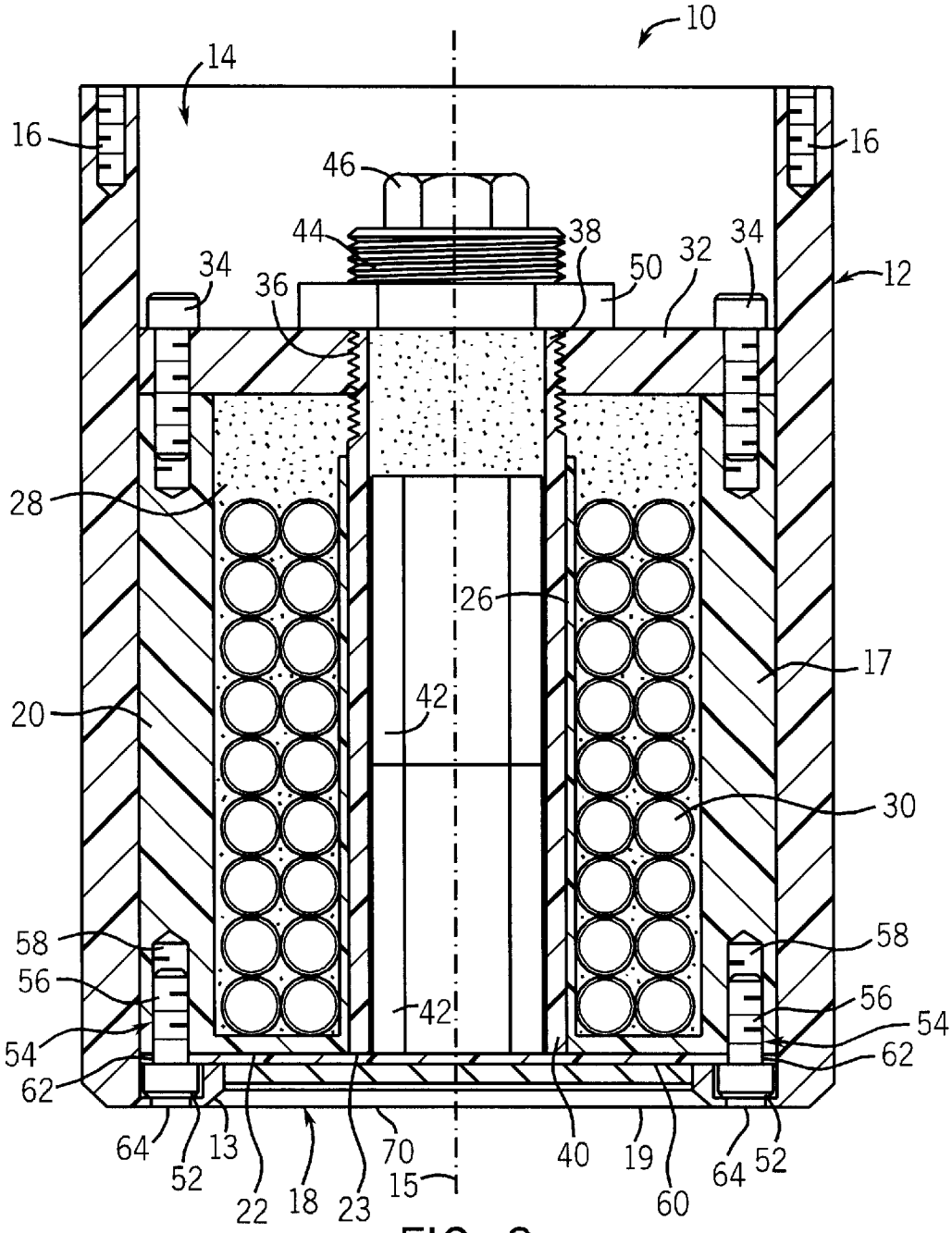
FIG. 2 is a side cross-sectional view of the sealing head of FIG. 1, showing the moveable sealing head housing in a fully lowered position.

The coil bobbin is attached to the housing 12 by an adjustment mechanism including adjustment fasteners 54 having a threaded end 56 disposed through recesses 52 in the cap plate 18 and threaded into threaded bores 58 in coil bobbin 20. The heads of the adjustment fasteners 54 are secured within the recesses 52 by a retaining plate 60 having bores 62 through which the adjustment fasteners 54 pass. Bores 64 extend from the bottom of the housing 12 into the recesses 52 so that the adjustment fasteners 54 can be accessed easily for adjustment. Referring to FIG. 2, by rotating the adjustment fasteners 54, the coil bobbin 20 can be positioned axially (up and down) within the housing 12.

The coil bobbin 20 is capped by an end cap 32 held in place with threaded fasteners 34. The end cap 32 has a threaded bore 36 concentric with the axis 15 for engagement with an externally threaded end 38 of an isolator housing 40 disposed within the wire support 26 of the coil bobbin 20.

The isolator housing 40 is a cylinder in which is disposed a triangular arrangement of magnetically isolating blocks 42, preferably made of a ferromagnetic compound having ferric oxide. A top end 44 of the isolator housing 40 is solid and forms a hexagonal head 46 for rotating the isolator housing 40 with a standard wrench. The isolator housing 40, as well as the coil bobbin 20, is filled with an epoxy resin, which secures the isolator blocks 42 and wire coil 30 in place.

The isolator housing 40 can be rotated by applying a rotational force to the head 46 so that the threads of the isolator housing 40 engage with the threaded bore 36 of the top plate 32 so that the isolator housing 40 moves axially with respect to the coil bobbin 20. Repositioning the isolator housing 40 with respect to the coil 30 alters the flux lines of the coil 30 and affects the magnitude of magnetic flux at the bottom of the sealing head 10 wherein containers are sealed. A locking nut 50 can be threaded onto the isolator housing 40 for fixing the relative position of the isolator housing 40 and the coil bobbin 20. The locking nut 50 would need to be loosened before adjusting the axial position of the coil bobbin 20 so that the isolator housing 40 is free to rotate.

The housing 12, coil bobbin 20 and isolator housing 40 are preferably constructed from acrylonitrile butadiene styrene ("ABS") plastic, as are the end cap 32 and retaining plate 60. A deformable pad, preferably made of silicon 70, can be disposed in the recess 19 in the cap plate 18, which compensates for irregularities in the height of a container or the surface of a container lid to ensure a proper seal.

Thus, the coil bobbin 20 can be adjusted with respect to the housing 12 and the isolator housing 40 can be adjusted with respect to the coil bobbin 20. Either or both of these adjustments alter the magnitude of the magnetic flux below the sealing head 10 where a container for sealing (not shown) would be disposed. By suitable calculation or empirical study, sealing heads 10 can be calibrated for a given container size to provide the appropriate magnetic flux and to ensure a proper seal of the container consistently.

For a multi-headed cap sealer, each sealing head 10 can be calibrated by a trial and error process wherein each coil bobbin 20 is set in the fully retracted position by rotating the adjustment fasteners 54 counterclockwise (after loosening the locking nut 50 on the isolator housing 40), then energizing the coil 30 to seal a container of a prescribed sized. If the container is found to be properly sealed, the same is done for the next sealing head 10. If the seal is unsatisfactory, however, the coil bobbin 20 can be incrementally lowered by tightening the adjustment fasteners 54 until a satisfactory seal is achieved.

Additionally, or alternatively, the isolator housing 40 can be incrementally repositioned as needed between energizing the sealing heads 10 being calibrated. The isolator housing 40 is repositioned by loosening the locking nut 50 and rotating the isolator housing 40 by applying a rotational force at the head 46, preferably using a standard sized wrench. When the isolator housing 40 is in the desired position, the locking nut 50 is re-tightened.

Figure 3:
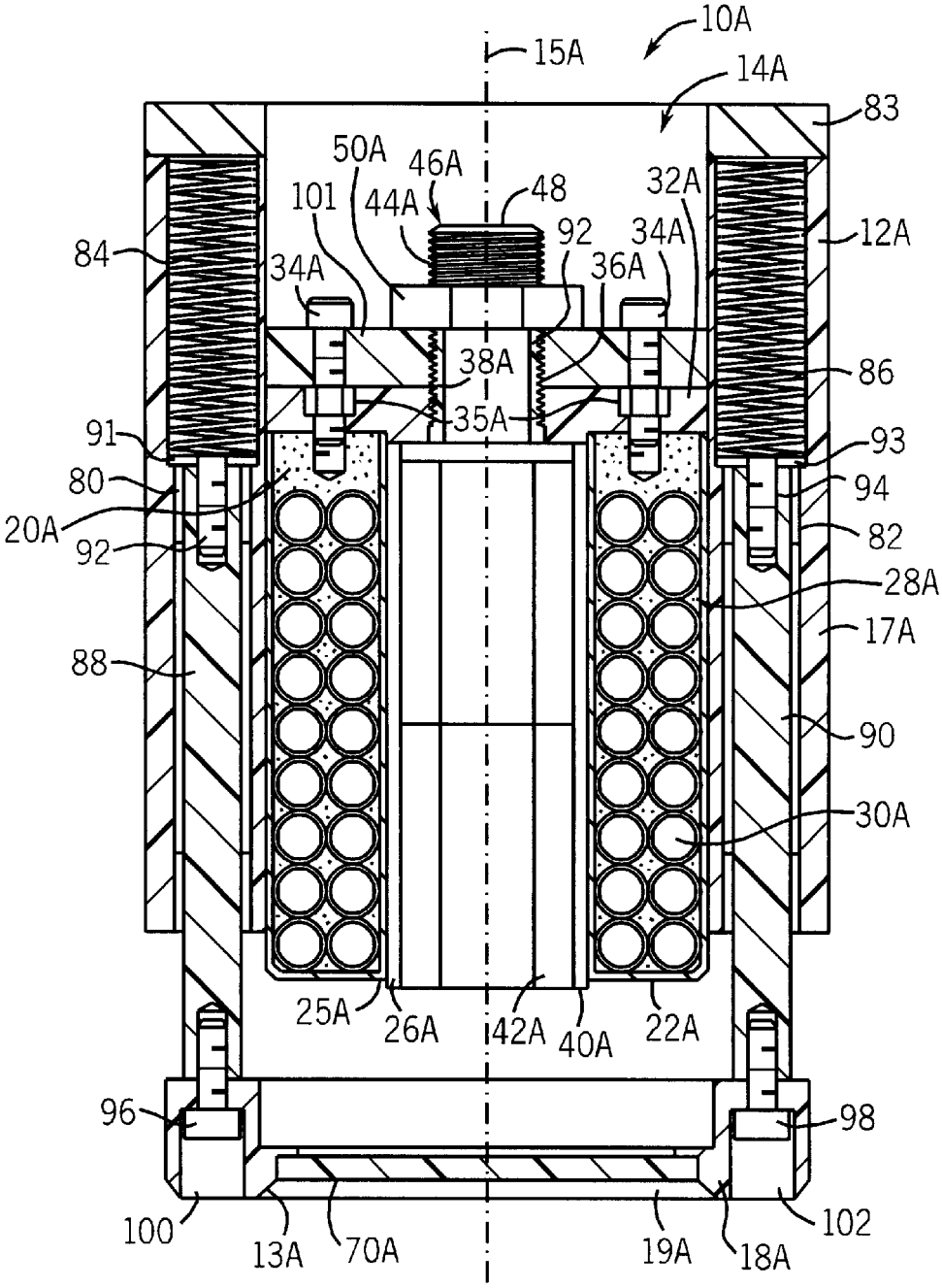
FIG. 3 is a side cross-sectional view of an alternate embodiment of the invention with a spring loaded container clamp shown in an extended position.
Figure 4:
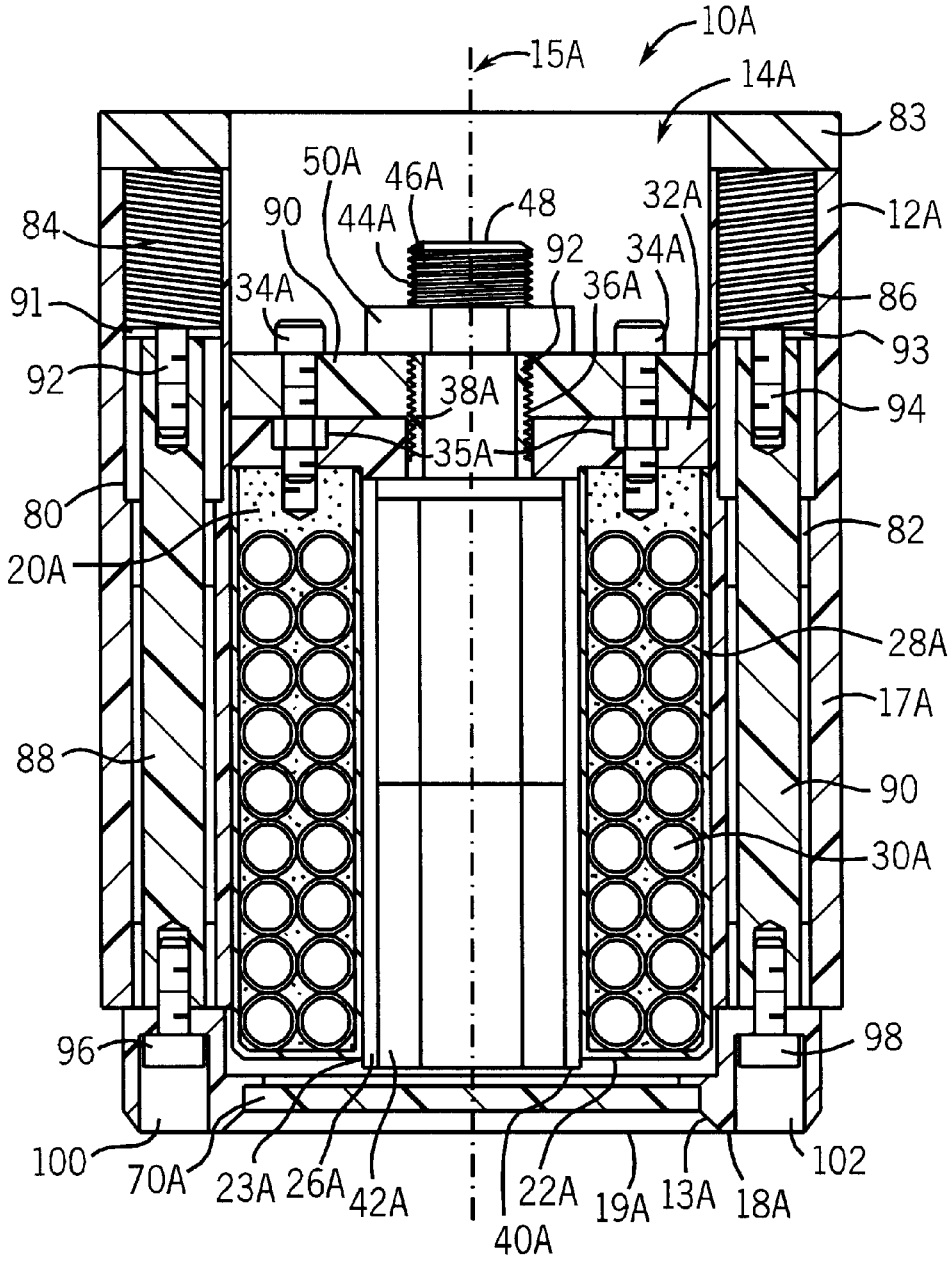
FIG. 4 is a side cross-sectional view of the alternate embodiment of FIG. 3 with the container clamp shown in a retracted position.

Another preferred embodiment of the invention is shown in FIGS. 3 and 4. Elements similar to the those of the above embodiment are referred to with like numerals albeit with the suffix "A". In this embodiment, the sealing head 10A includes a housing 12A secured to the cap sealer lift mechanism at its top end. The housing 12A is generally cylindrical in shape defining a cylindrical cavity 14A therethrough opening to the bottom of the sealing head 10A and extending along a central axis 15A.

The housing 12A includes two axial through bores 80 and 82 closed at the top end by a ring 83 bolted to the top of the housing 12A. Each bore 80 and 82 contains a compression spring 84 and 86 and a push rod 88 and 90, respectively. The springs 84 and 86 are disposed in enlarged sections of the bores 80 and 82. The push rods 88 and 90 engage the springs 84 and 86 through washers 91 and 93 connected to the top ends of the push rods 88 and 90 by threaded fasteners 92 and 94, respectively. The washers 91 and 93 also engage the shoulders of the bores 80 and 82 at the bottom of the enlarge sections to retain the push rods 88 and 90 in the bores 80 and 82, respectively. A cap plate 18A is fastened to the bottom of the push rods 88 and 90 by threaded fasteners 96 and 98 disposed in bores 100 and 102, respectively. The cap plate 18A defines an opening 19A having an inwardly tapered circumference 13A, which aids in centering the container being sealed.

A coil bobbin 20A is disposed in the cavity 14A of the housing 12A and has a cylindrical wall 17A with a bottom 22A and a top end cap 32A. The bottom 22A has a through opening 23A and the end cap 32A has a threaded opening 36A, both concentric with the axis 15A. A cylindrical wire support 26A extends along the axis 15A within the coil bobbin 20A from the bottom opening 23A. The coil bobbin 20 thus defines an annular chamber 28A in which a wire coil 30A (as described above) is disposed.

The coil bobbin 20A is mounted to the housing 12A at a radial support plate 101 bolted radially to the cylindrical wall 17A of the housing 12A. Adjustment fasteners 34A extend through bores in the support plate 101 and thread into set collars 35A disposed in recesses in the end cap 32A of the coil bobbin 20A. The adjustment fasteners 34A also thread into threaded bores beneath the recesses extending through the end cap 32A of the coil bobbin 20A. This arrangement allows the axial position of the coil bobbin 20A to be changed by rotating the adjustment fasteners 34A to engage the threaded bores in the end cap 32A of the coil bobbin 20A.

The support plate 101 has a threaded bore 92, which engages (along with bore 36A in the end cap 32A) a threaded top end 38A of an isolator housing 40A disposed within the wire support 26A of the coil bobbin 20A. The isolator housing 40A is a cylinder containing magnetically isolating blocks 42A held in place with an epoxy. A top end 44A of the isolator housing 40A is solid and forms a slot 48 at the top for receiving the blade of a screwdriver. The isolator housing 40A can be rotated with a screwdriver so as to move axially with respect to the coil 30A in the coil bobbin 20A (as described above). A locking nut 50A can be threaded onto the isolator housing 40A for fixing the relative position of the isolator housing 40A and the coil bobbin 20A. As with the first described embodiment, the locking nut 50A would need to be loosened or removed before adjusting the position of the coil bobbin 20A with respect to the housing 12A.

Thus, like the above described embodiment, the magnetic field can be varied with respect to the container being sealed by axially adjusting the coil bobbin 20A with respect to the outer housing 12A and by adjusting the axial position of the isolator housing 40A in the wire coil 30A. Either or both of these adjustments alter the magnitude of the magnetic flux below the sealing head 10A where a container for sealing would be disposed.

Moreover, in this embodiment, the spring loaded cap plate 18A is biased away from the outer housing 12A by the springs 84 and 86, as shown in FIG. 4. When sealing a container with a rotary type cap sealer, for example, the cap plate 18A will engage a container placed or conveyed beneath the cap sealer. As the carriage mechanism rotates the sealing head 10A over the container, the tapered circumference 13A of the recess 19A will engage the cap of the container and center the container with the sealing head 10A. As the sealing head continues to rotate and engage the container cap, the cap plate 18A will be forced upward and the compression of the springs 84 and 86 will provide a downward clamp force on the cap to seat the cap and inner seal against the sealing surface (rim) of the container to ensure proper seating of the seal on the lip of the container. It should be noted that the cap plate 18A will engage the seal directly if the container does not include a cap. As the sealing head 10A continues to rotate, the cap plate 18A disengages from the cap (or seal) and extends outward due to the spring force until the washers 91 and 93 seat against the shoulders in the bores 80 and 82.

As in the first embodiment, the housing 12A, coil bobbin 20A, isolator housing 40A and end cap 32A are preferably constructed of ABS plastic. The cap plate 18A is preferably a suitable phenolic or glass fiber reinforced epoxy and the push rods are preferably a suitable metal. A deformable silicon pad 70A can be placed in the recess 19A in the cap plate 18A. Additionally, as above, the magnetic flux of the sealing head can be set by calculation or empirical study and incremental adjustment of the coil 20A and isolator 40A housings until proper sealing is achieved.

Preferred embodiments of the invention have been described in detail for the purpose of disclosing practical, operative structures whereby the invention may be practiced advantageously. The design described is intended to be illustrative only. The novel characteristics of the invention may be incorporated in other structural forms without departing from the scope of the invention.

We claim:

1. An adjustable sealing head for use with an inductive sealing apparatus, the sealing head comprising:

a housing defining a cavity that is disposed about and extends along a central axis;

a coil bobbin disposed in the housing cavity and having a cylindrical support extending along the central axis;

a wire coil wound about the cylindrical support and capable of producing a magnetic field when energized; and an adjustment mechanism for attaching the coil bobbin to the housing and enabling the manual adjustment of the coil bobbin in the axial direction with respect to the housing.

2. The sealing head of claim 1, wherein a cap plate is fixed with respect to the housing at one end of the cavity and wherein the adjustment mechanism includes threaded fasteners disposed through the cap plate and in threaded engagement with the openings in the coil bobbin.

3. The sealing head of claim 2, wherein the cap plate includes a recess concentric with the central axis having an inwardly tapered circumference.

4. The sealing head of claim 2, further including a magnetic isolator disposed along the central axis within the support cylinder so as to be adjustable with respect to the coil bobbin.

5. The sealing head of claim 4, wherein the bobbin further includes a radial end cap for enclosing the wire coil and having a threaded opening concentric with the central axis.

6. The sealing head of claim 5, wherein the magnetic isolator is contained in an isolator housing disposed in the cylindrical support and extending along the central axis, wherein the isolator housing has a threaded end engageable with the threaded opening in the end cap so that the isolator housing can be axially adjusted with respect to the coil bobbin.

7. The sealing head of claim 6, further including a locking nut engaging the threaded end of the isolator housing for fixing the axial position of the isolator housing with respect to the coil bobbin.

8. The sealing head of claim 7, wherein the isolator housing includes a head for manually rotating the isolator housing with respect to the coil bobbin.

9. The sealing head of claim 7, wherein the isolator housing includes a slot for manually rotating the isolator housing with respect to the coil bobbin.

10. The sealing head of claim 1, further including a radially extending support member fixed to the housing within the cavity, and wherein the coil bobbin further includes a radial end cap.

11. The sealing head of claim 10, wherein the adjustment mechanism includes threaded fasteners disposed through the support member and in threaded engagement with the openings in the end cap of the coil bobbin.

12. The sealing head of claim 11, wherein the housing includes at least one axial aperture in which is disposed a spring acting on one end of a push rod connected to a cap plate at its opposite end so that the cap plate is biased away from and axially repositionable with respect to the housing.

13. The sealing head of claim 12, wherein the cap plate includes a recess concentric with the central axis having an inwardly tapered circumference.

14. The sealing head of claim 12, further including a magnetic isolator disposed along the central axis within the support cylinder so as to be adjustable with respect to the coil bobbin.

15. The sealing head of claim 14, wherein the magnetic isolator is contained in an isolator housing disposed in the cylindrical support and extending along the central axis, wherein the isolator housing has a threaded end engageable with a threaded opening in the end cap concentric with the central axis so that the isolator housing can be axially adjusted with respect to the coil bobbin.

16. The sealing head of claim 15, further including a locking nut engaging the threaded end of the isolator housing for fixing the axial position of the isolator housing with respect to the coil bobbin.

17. An adjustable sealing head for use with an inductive sealing apparatus, the sealing head comprising:

a housing defining a cavity that is disposed about and extends along a central axis;

a coil bobbin disposed in the housing cavity and having a cylindrical support extending along the central axis;

a wire coil wound about the cylindrical support and capable of producing a magnetic field when energized;

a magnetic isolator disposed within the cylindrical support and adjustable along the central axis with respect to the coil bobbin; and an adjustment mechanism for attaching the coil bobbin to the housing and enabling the manual adjustment of the coil bobbin in the axial direction with respect to the housing.

18. An adjustable sealing head for use with an inductive sealing apparatus, the sealing head comprising:

a housing defining a cavity that is disposed about and extends along a central axis;

a cylindrical housing defining a central cavity and a pair of axial apertures in the cylindrical wall;

a coil bobbin disposed in the housing cavity and having a cylindrical support extending along the central axis, the coil bobbin being connected to the housing by an adjustment mechanism enabling manual adjustment of the coil bobbin in the axial direction with respect to the housing;

a wire coil wound about the cylindrical support and capable of producing a magnetic field when energized;

a magnetic isolator disposed within the cylindrical support and adjustable along the central axis with respect to the coil bobbin; and a pair of spring and push rod assemblies disposed in the pair of axial apertures; and a cap plate connected to the push rods and biased away from the housing.

* * * * *